US008308083B2

(12) United States Patent
Woodgate et al.

(10) Patent No.: US 8,308,083 B2
(45) Date of Patent: Nov. 13, 2012

(54) SPRAY GUN

(75) Inventors: Sarah Jane Woodgate, Tonbridge (GB); Timothy George Hopper, Normandy (GB)

(73) Assignee: Earlex Limited, Guildford, Surry (GB)

( * ) Notice: Subject to any disclaimer, the term of this patent is extended or adjusted under 35 U.S.C. 154(b) by 287 days.

(21) Appl. No.: 12/660,482

(22) Filed: Feb. 26, 2010

(65) Prior Publication Data

US 2010/0224700 A1 Sep. 9, 2010

(30) Foreign Application Priority Data

Feb. 26, 2009 (GB) ..... 0903275.6

(51) Int. Cl.
*B05B 1/28* (2006.01)
*B05B 7/02* (2006.01)

(52) U.S. Cl. ..... 239/297; 239/296; 239/300; 239/301; 239/373; 239/526; 239/600

(58) Field of Classification Search ..... 239/290, 239/296–298, 300, 301, 373, 418, 423, 424, 239/525, 526, 600, DIG. 14
See application file for complete search history.

(56) References Cited

U.S. PATENT DOCUMENTS

| | | | | |
|---|---|---|---|---|
| 1,627,117 | A * | 5/1927 | Preble et al. | 239/297 |
| 3,843,052 | A * | 10/1974 | Cowan | 239/3 |
| 5,141,161 | A * | 8/1992 | Anderson et al. | 239/300 |
| 6,776,360 | B2 * | 8/2004 | Haruch et al. | 239/591 |
| 2004/0046040 | A1 * | 3/2004 | Micheli | 239/11 |
| 2008/0295768 | A1 * | 12/2008 | Micheli et al. | 118/300 |

* cited by examiner

*Primary Examiner* — Darren W Gorman
(74) *Attorney, Agent, or Firm* — Lambert & Associates; Gary E. Lambert; David J. Connaughton, Jr.

(57) ABSTRACT

An air spray gun for paint has a tubular body, having an integral screw thread receiving a threaded collar. This secures an air cap against the end of the tube. The air cap has four horns, formed with obliquely inwards directed bores, for patterning the spray, by impinging on it from opposite sides in a manner analogous to that of known air caps having two horns. Behind the air cap in the tube is an air distributor for distributing air to either or both of the pairs of air horns as required to patterning of the paint spray. Paint flow is controlled by a needle withdrawable from a paint nozzle. The needle is in two parts, a front interchangeable part and a rear part connected to the trigger.

28 Claims, 10 Drawing Sheets

SPRAY GUN

CROSS REFERENCE TO RELATED APPLICATION

This application takes priority from and claims the benefit of United Kingdom Patent Application Ser. No. 0903275.6 filed on Feb. 26, 2009.

BACKGROUND OF THE INVENTION

1. Field of the Invention

The present invention relates to a spray gun, particularly though not exclusively for spraying paint.

2. Description of the Related Art

In this specification the term "spray liquid" is used to refer to paint or other liquid to be sprayed.

Generally spray guns are of two types, (i.) those operated by pumping the spray liquid to a nozzle whence it sprays under momentum imparted by being pumped through the nozzle and (ii.) those operated by blowing gas—usually air—past a nozzle, the air drawing the spray liquid from the nozzle and imparting momentum to it. Flow of paint can be regulated with a needle extending into the nozzle. The spray liquid may enter the nozzle at atmospheric or elevated pressure. This type of spray gun is referred to here as an "air spray gun". Air spray guns themselves are of two further types, those operating at conventional compressed air pressure and those operating at low pressure, but with high volume flow. These are known as HVLP spray guns. The invention relates to BOTH types of air spray gun.

Paints are of widely differing viscosities. Thus some thick paints require one needle and other thin paints require another needle. Needle exchange is awkward, to the extent that in European Patent Application No. 1,340,550, in the name of J Wagner GmbH, interchange of the complete front of the gun is proposed.

In our existing air spray gun, which is an HVLP gun, the needle is exchanged by removal of the needle backwards, leaving the nozzle in place. Simultaneously the nozzle can be removed forwards, by unscrewing, once the air cap is removed.

Typically an air spray gun comprises:

- an air flow passage in the gun;
- a spray liquid nozzle mounted in the air flow passage and having an orifice for spray liquid to flow from, the orifice being on the downstream side of the spray liquid nozzle with respect to both air and spray liquid flow;
- a needle extending from upstream into the spray liquid nozzle for regulating its orifice and flow of the spray liquid;
- a spray liquid flow passage to the spray liquid nozzle, with the needle extending in the spray liquid flow passage;
- a flow-passage/needle seal at a position along the needle spaced from the spray liquid nozzle;
- a trigger mechanism connected to the needle to regulate its position;
- an air cap defining with the spray liquid nozzle:
  - a convergent air flow region immediately upstream of the spray liquid orifice,
  - a central opening from which spray liquid entraining air flows and
  - a pair of opposed horns having spray patterning bores with orifices directed inwards for patterning the spray liquid containing air flow from the central opening and
- an air distributor upstream of the air cap for distributing air to the patterning bores.

This air spray gun is referred to as being "of the type defined."

SUMMARY OF THE INVENTION

The object of the present invention is to provide an air spray gun having an improved needle replacement facility.

According to a first aspect of the invention there is provided an air spray gun of the type defined, in which:

- the needle has
  - an exchangeable front part including a tip extending in the spray liquid nozzle and
  - a rear part with which the front part is engageable and to which the trigger mechanism connects Conveniently, the exchangeable front part of the needle has a formation with which it can be gripped for its exchange.

Whilst it is envisaged that the seal between the needle and the spray liquid flow passage can be arranged at the rear part of the needle; it is preferred to arrange it at the front part, in order to isolate an engagement region between the two parts from the spray liquid. The engagement region will usually include complementary threads on the two parts. An envisaged alternative is a bayonet fitting connection of the two parts.

The seal may be removable with the needle or it may remain in the member providing the spray liquid flow passage.

In our existing air spray gun, the air cap is rotatable and the air distributor is fixed, having passages set at 12 o'clock, 3 o'clock, 6 o'clock and 9 o'clock with respect to the normal orientation of the air spray gun for providing patterning air flow to the patterning bores when the horns are at 12 o'clock and 6 o'clock or at 3 o'clock and 9 o'clock. We can envisage this arrangement with the two part needle of the first aspect of the present invention. However, as in the preferred embodiment, we prefer to provide that: incorporates the feature of the following, second aspect of the invention.

According to a second aspect of the invention there is provided an air spray gun of the type defined, in which:

- the air cap has
  - two pairs of opposed horns, the four horns being set at 12 o'clock, 3 o'clock, 6 o'clock and 9 o'clock with respect to the normal orientation of the air spray gun, each horn having a spray patterning bore with an orifice directed inwards and
- the air distributor has a pair of diametrically arranged apertures through it and is rotatable to connect its apertures with one or other pair of opposed horns.

In the preferred embodiment, the air distributor has circumferential grooves facing the air cap, each groove having a quarter circle extent and having one of the diametrically arranged apertures communicating with it. Preferably the apertures open into the middles of the grooves.

The apertures in the rear face of the air cap also can have circumferentially extended orifices, whereby at mid position of the air distributor, it supplies air flow to the bores in all four horns.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENT

Figure 1:
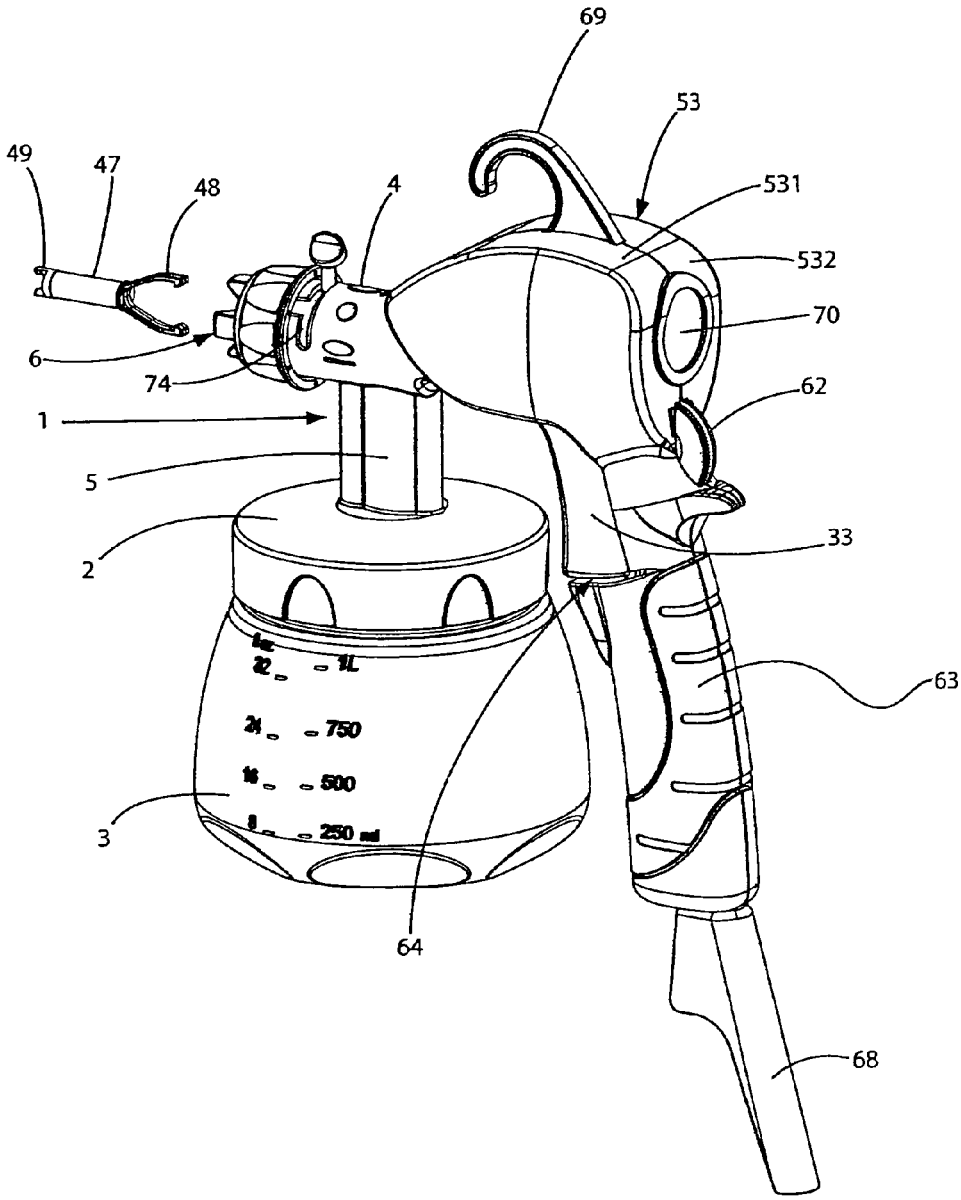
FIG. 1 is a perspective view of an air spray gun according to the invention.
Figure 2:
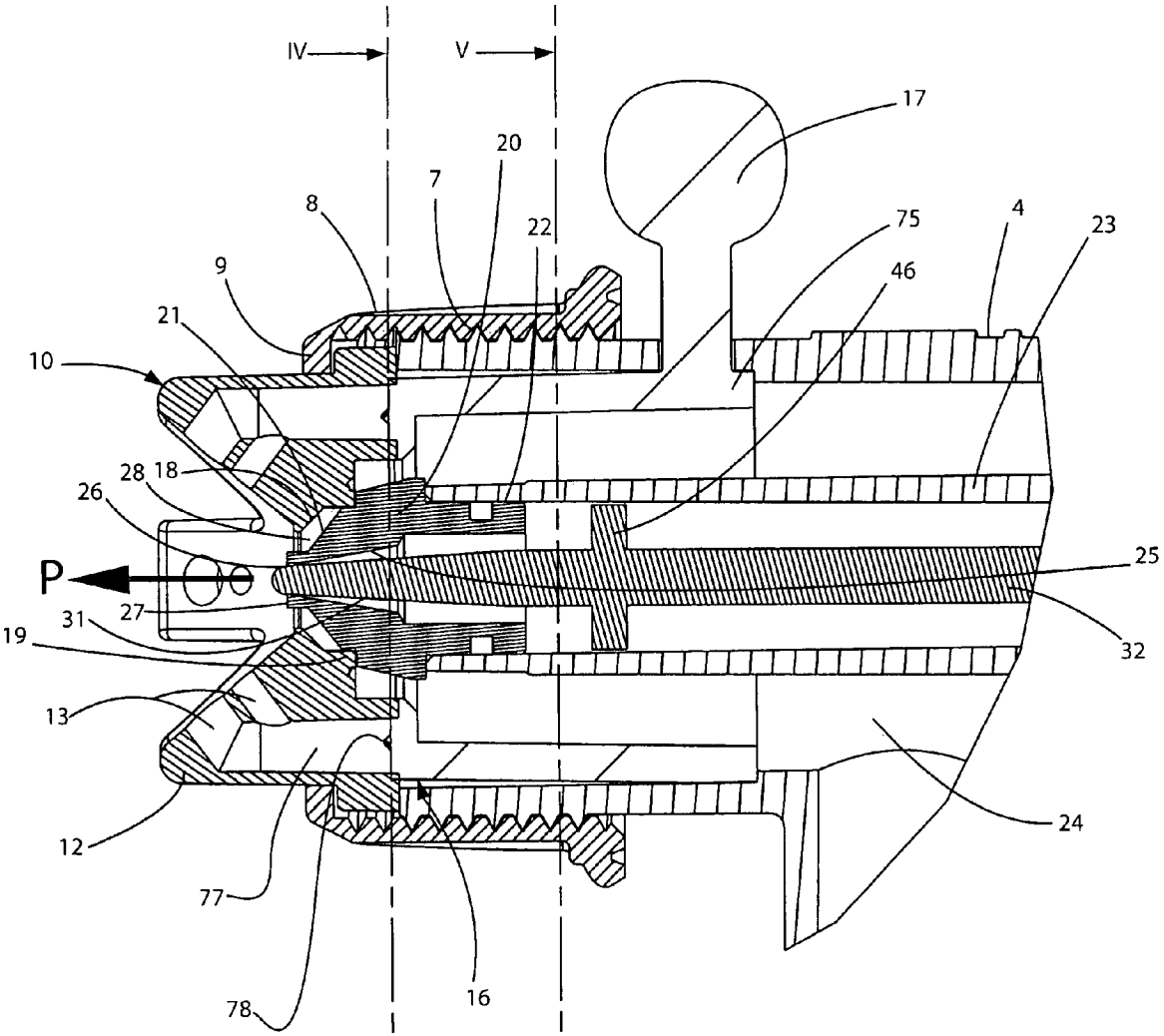
FIG. 2 is a central cross-sectional view through the front, nozzle end of the gun.
Figure 3:
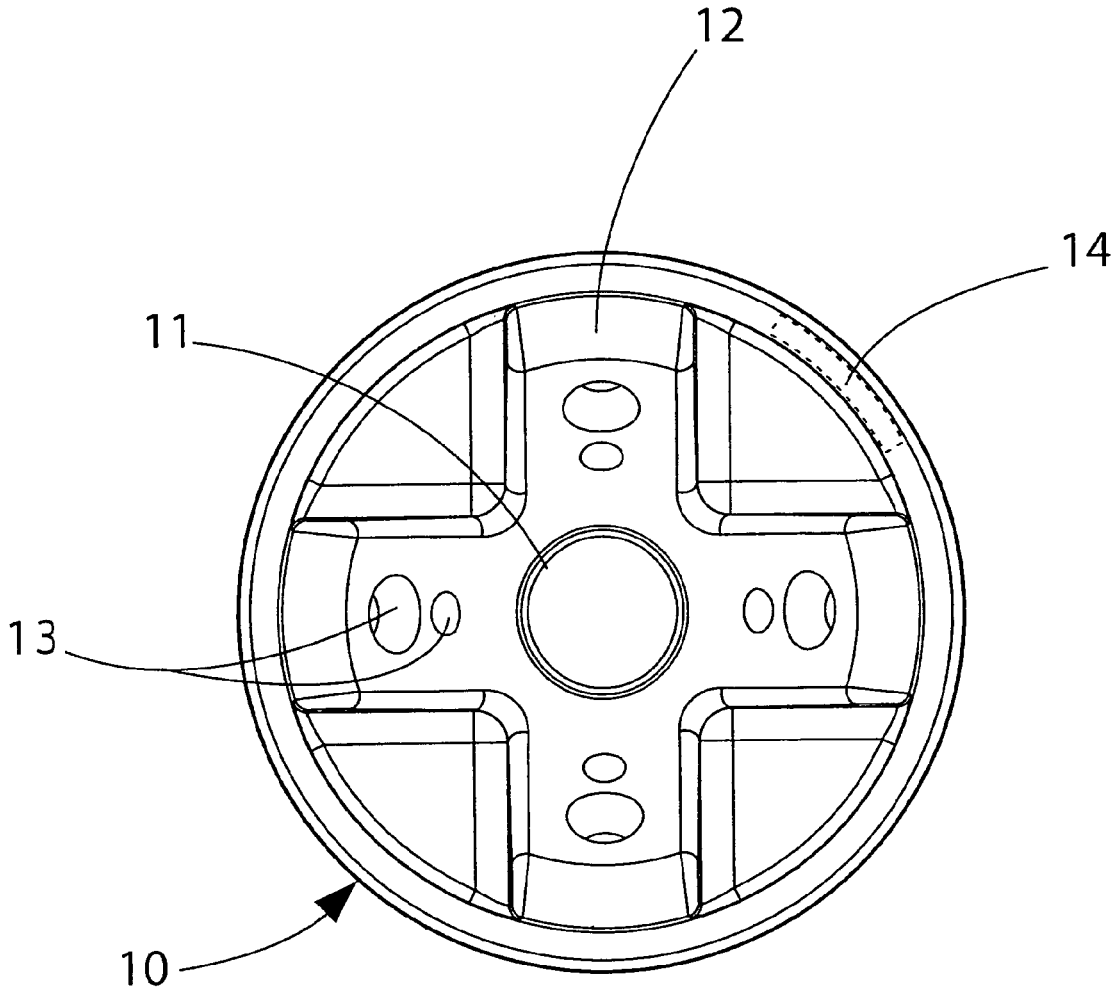
FIG. 3 is a front view of an air cap shown in FIG. 2.
Figure 4:
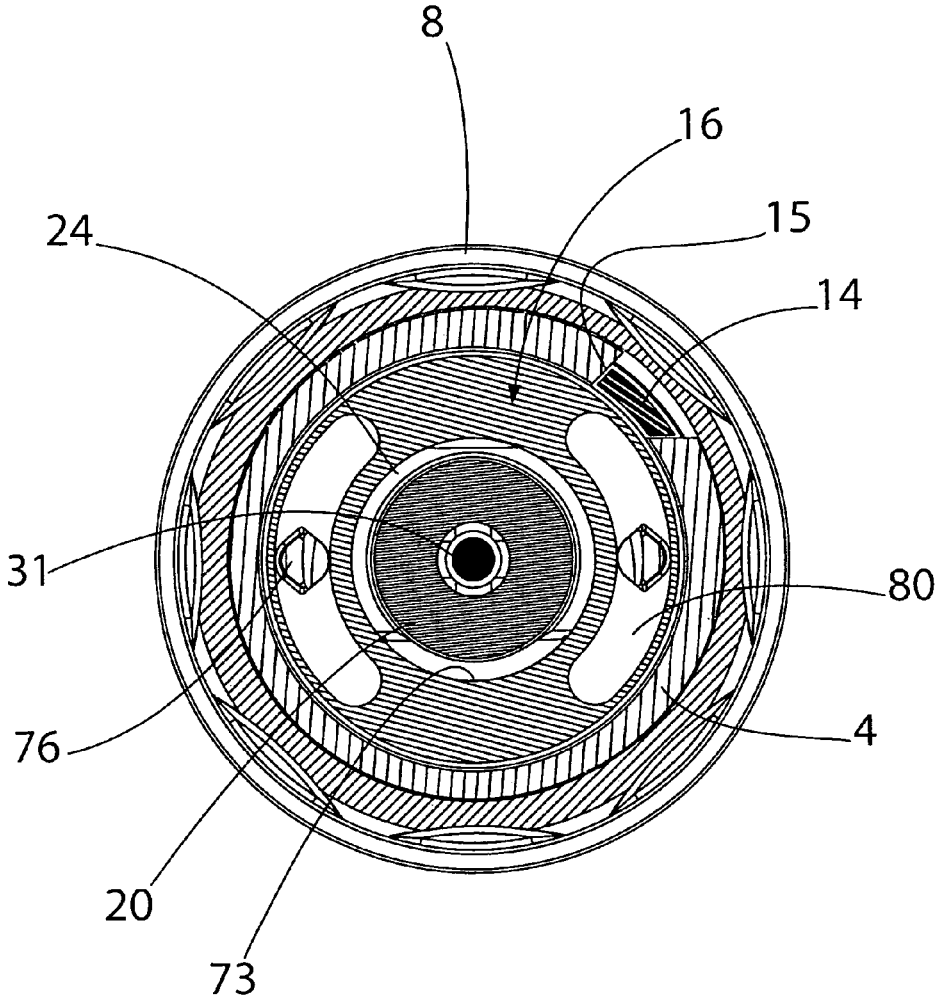
FIG. 4 is a cross-sectional view on the line IV-IV in FIG. 2.
Figure 5:
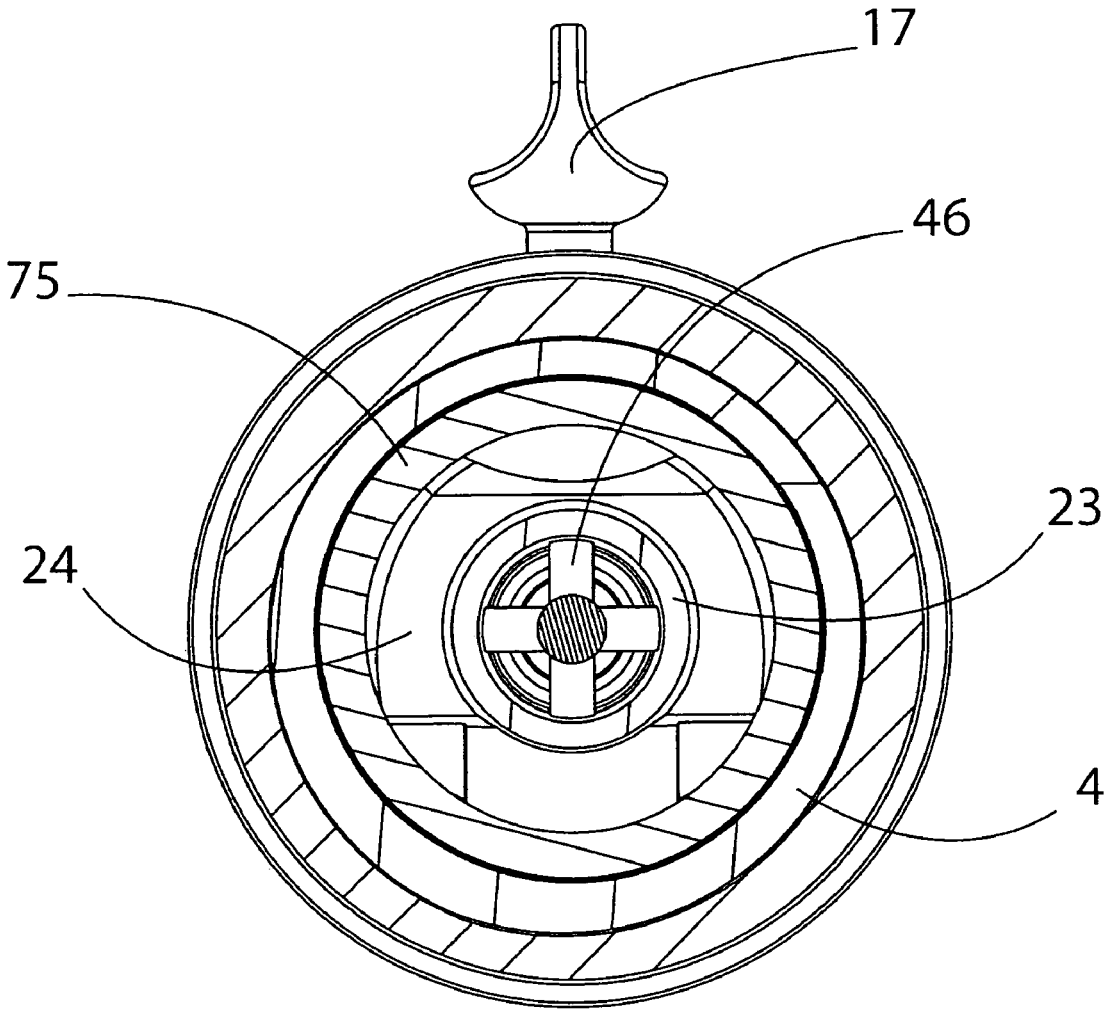
FIG. 5 is a cross-sectional view on the line V-V in FIG. 2.
Figure 6:
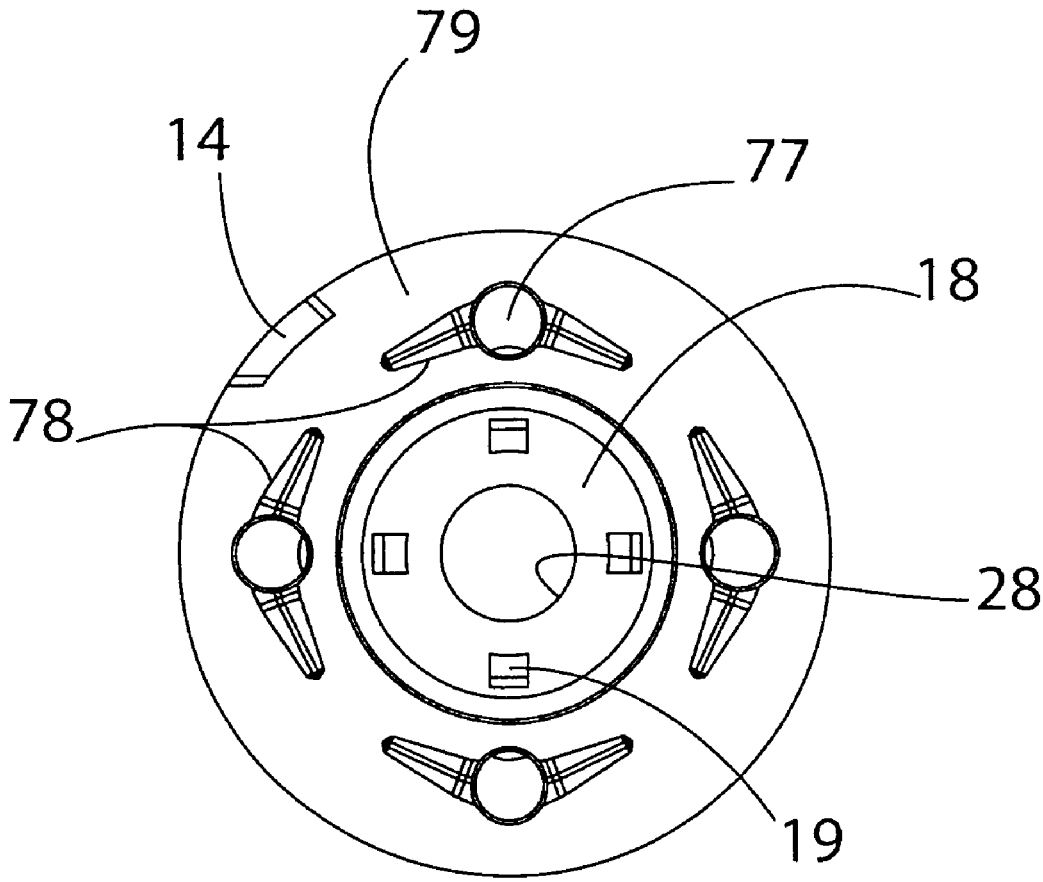
FIG. 6 is a rear view of the air cap of FIG. 3.
Figure 7:
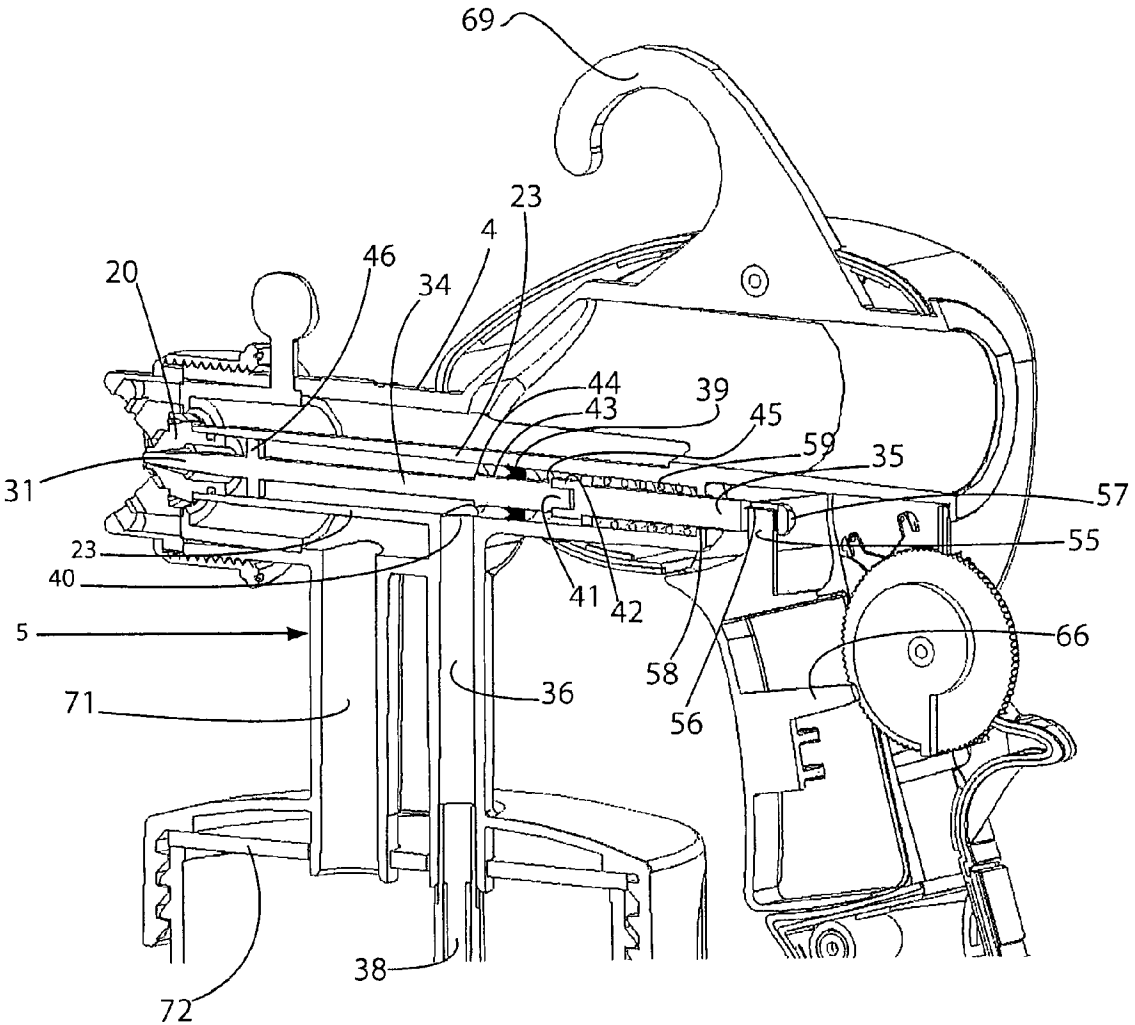
FIG. 7 is an oblique cross-sectional view on the same plane as FIG. 1, showing the full length of a paint flow control needle.
Figure 8:
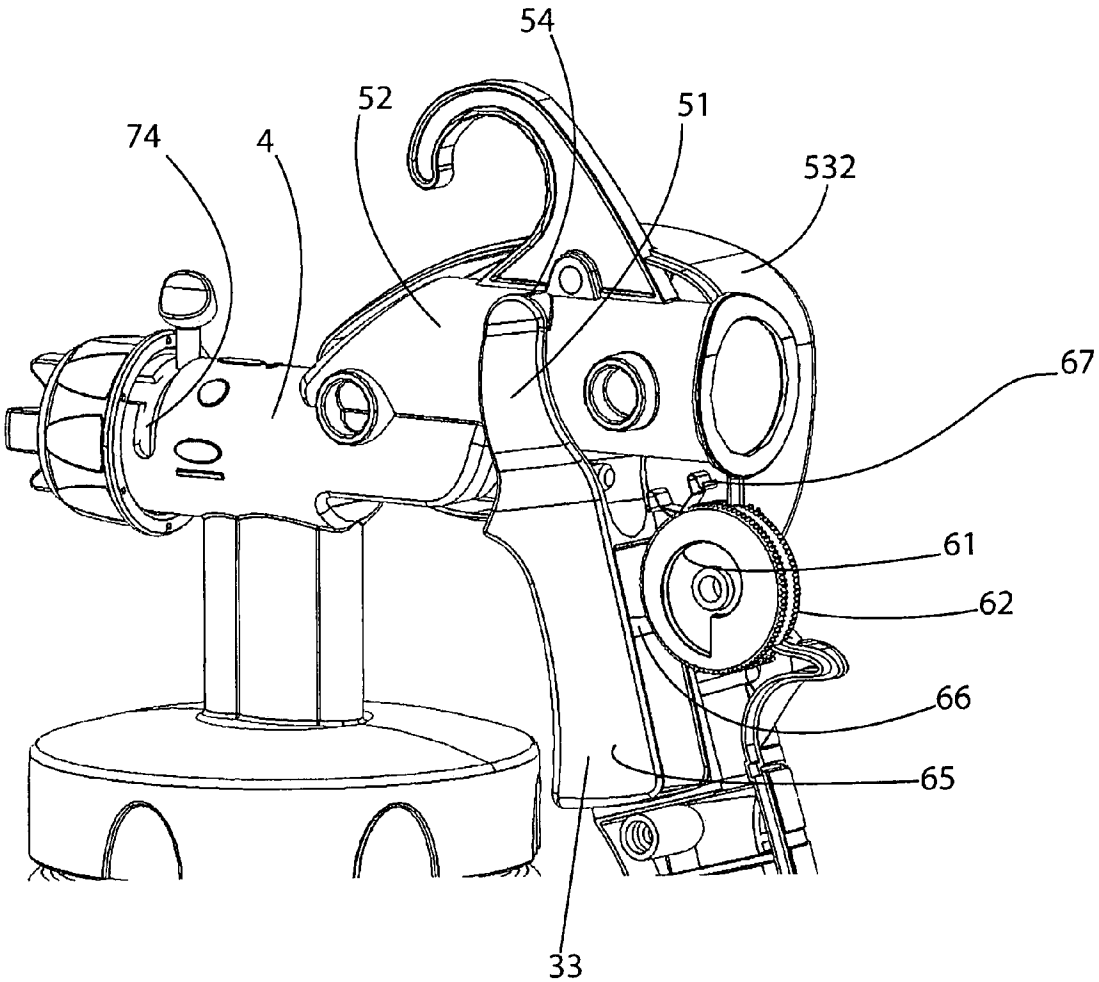
FIG. 8 an oblique view of an upper part of the air gun showing a casing partially removed around a trigger.
Figure 9:
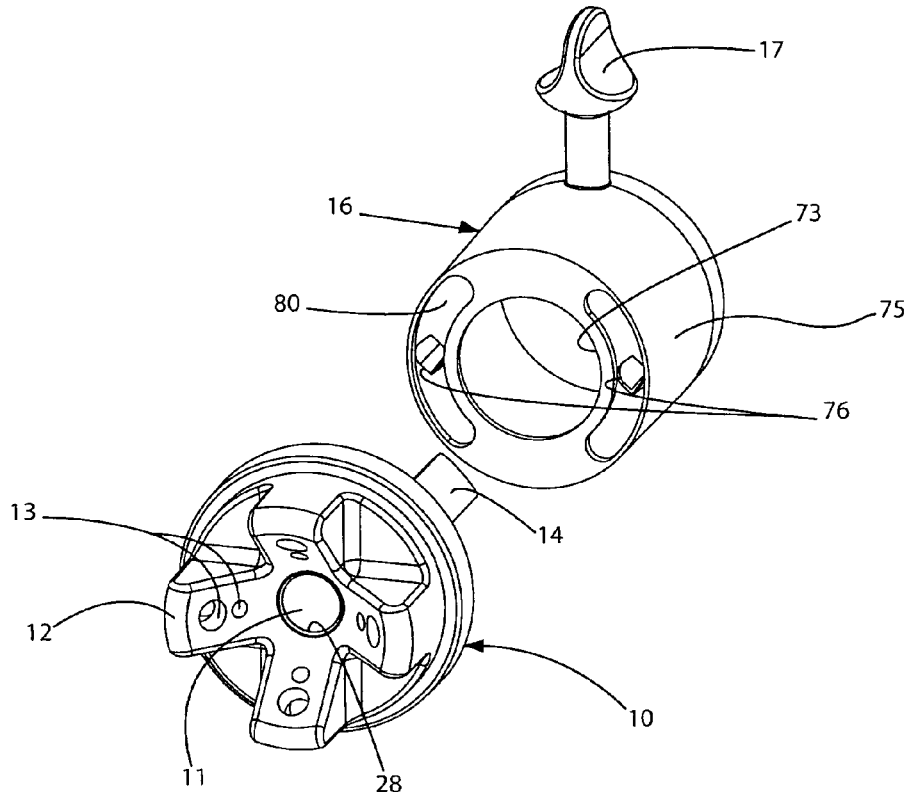
FIG. 9 is a front perspective view of the air cap and air distributor only of the air spray gun.
Figure 10:
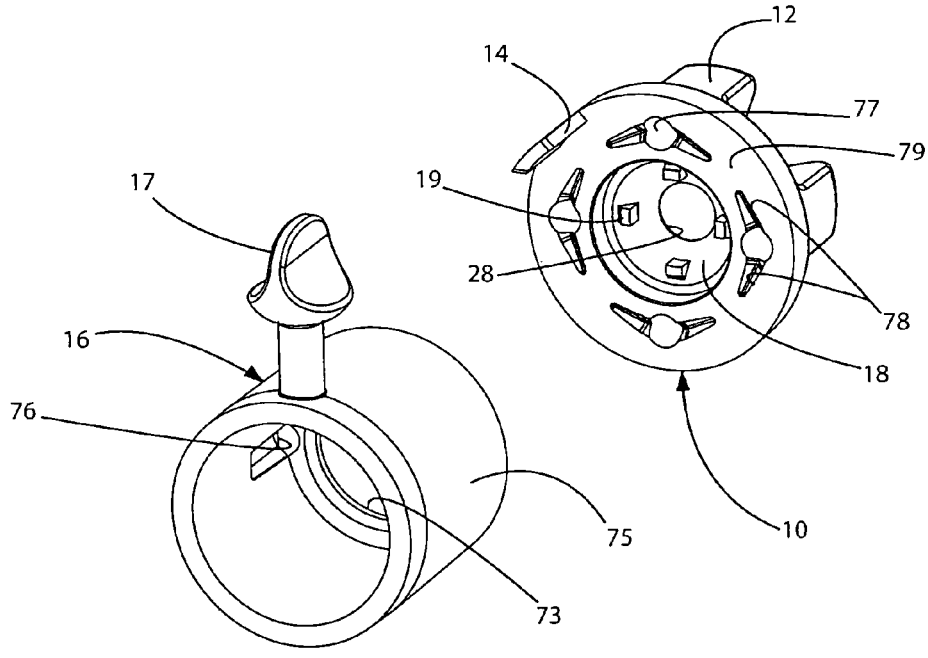
FIG. 10 is a similar rear perspective view.

Referring to the drawings, an air spray gun for paint has a body 1, including a lid 2 for a paint container 3. A forward portion 4 of the body is generally tubular and having a dual duct connection 5 to the lid and a spray nozzle arrangement 6 at a forward end. Except for a small number of metal components, the gun is preferably of polypropylene mouldings.

The tube 4 has an integral screw thread 7 receiving a threaded collar 8, which is formed externally for finger tightening and has a front in-turned lip 9. This secures an air cap 10 against the end of the tube 4. The air cap is of heavily filled polymer for wear resistance and has a central aperture 11 for allowing exit of an air flow with entrained paint droplets in the general direction of the arrow P. The air cap also has four horns 12, formed with obliquely inwards directed bores 13, for patterning the spray, by impinging on it from opposite sides in a manner analogous to that for known air caps having two horns.

However in contrast to our existing air spray gun, in which the air cap has two horns and is indexable to adjust the spray shape, the air cap 10 has a tang 14 engaging in a slot 15 in the end of the tube. This holds the air cap against rotation. Behind the air cap in the tube is an air distributor 16 having an adjustment lug 17, which extends out of the tube via a Tee head of the slot 15. The distributor will be described in more detail below.

The inner face of air cap is conical 18 and has a set of four nibs 19. These abut a nozzle 20 from which paint exits in use, the nozzle being of brass or engineering plastics material. This paint nozzle has a front face 21, which is conical and complementary to the shape of the face 18, and a rear spigot 22. The latter locates in an inner tube 23 integrally moulded with the tube 4, leaving an annular air duct 24 between the two tubes. The paint nozzle has a tapered bore 25, which has its small diameter end at its front orifice 26. A small boss 27 is provided on the front of the nozzle around the orifice and is positioned within the aperture 11 of the air cap 10, providing an air outlet 28 of known cross-sectional area. The paint nozzle is centred in the air cap by the nibs 19.

A tapered tip 31 of a needle 32 extends into the orifice 26, to seal it when not in use and able to be moved back out of it for use by a trigger 33 as described below. The needle is in two parts, a front interchangeable part 34 and a rear part 35 connected to the trigger. The front part extends in the inner tube 23. This, via a duct 36 in the dual duct connection 5 and a pick-up tube 38 to the bottom of the paint container 3 provides a paint flow path to the nozzle 20. Thus the front part, at least as far back as a seal 39 is surrounded by paint in use. The seal is carried by the front part behind a junction 40 of the duct 36 and the inner tube 23. It prevents flow of paint back along the front part to the rear part of the needle. The parts are interconnected by a male thread 41 on the front part and a female thread 42 in the rear part. The seal prevents the paint from reaching the threads and clogging them. It is carried on a parallel section 43 of the front part of the needle between two ridges 44, 45 and is an elastomeric double lip seal.

Close behind the nozzle is a cruciform formation 46 on the front part of the needle. A tool 47 is provided and formed with tweezers jaws 48 for pulling the nozzle out of its tube and with fingers 49 complementary to the formation 46, whereby the front part of the needle can be unscrewed and removed, drawing the seal out with it. As the viscosity of the paint to be sprayed dictates, the nozzle and needle front part are replaced with another matched pair.

The trigger 33 is bifurcated 51 at its top, extending around a rear extension 52 of the tube 4 within an outer casing 53 to a pivot point 54 on the top of the extension 52. Below the extension it has a tang 55, which projects into a slot 56 at the distal end 57 of the rear part of the needle. This end 57 extends outside the tubes 4,23 below the extension 52, passing through a needle-end guide 58. The guide acts as a stop for a spring 59 carried on the needle and acting on its rear part immediately behind the female thread 42. Thus the needle is urged forwards into its closed position by the spring and can be drawn back for paint flow by the trigger.

The extent to which the needle can be drawn back is regulated by a snail cam 61 integral with a thumb wheel 62, rotationally carried between two halves 531,532 of the casing 53, which are continued down from the rear extension 52 of the tube 4 into a pair of handle grip moulding 63. The root of the handle has a recess 64 occupied by the trigger, with sides 65 of the trigger fitting outside the forward extent of the thumb wheel. Between the sides 65, the trigger has a prong 66 projecting towards the cam 61 to limit movement of the trigger. A spring steel pawl 67 engages the top of the thumb wheel to hold it in an adjusted position.

An optional extension 68 engages in recess in the bottom of the handle. A hook 69 extends up from the top of the tube extension 52.

The rear end of the tube extension 52 has a socket 70 for a supply of HVLP air. The extension follows a stepped down route to the main part of the tube 4. In front of the duct 36 providing for paint flow up from the container 3, the tube 4 does extend below the inner tube 23. A second duct 71 provides for the pressure of the air in the tube 4 to be applied into the paint container, which has a seal 72 at the lid. Thus paint is urged up the duct 36 via the pick-up tube 38.

At the front of the inner tube, the bulk of the HVLP air flows through a central aperture 73 in the air distributor 16. This is adjustable in its rotary position with respect to the inner tube, by the lug 17 extending out via the Tee head 74 of the slot 15. The air distributor has a skirt 75 extending back to close the slot, whereby air cannot escape via it. The air distributor has a pair of diametrically arranged bores 76, set at the same radius as internal bores 77 in the horns 12 in the air cap, for communicating with the spray shaping bores 13. The internal bores 77 and indeed the horns 12 are set at 12 o'clock, 3 o'clock, 6 o'clock and 9 o'clock with respect to the normal orientation of the spray gun and held there by the tang 14. The bores 77 have circumferentially extended orifices 78 in a rear face 79 of the air cap abutting the air distributor. The air distributor 16 has circumferential grooves 80 extending by an eighth of a circle in both directions from the bores 76, the bores communicating air flow to the grooves.

The Tee head slot 74 extends through 90°, or at least allows 90° of angular adjustment of the air distributor. In extreme positions of the air distributor, the grooves 80 are in register with the extended orifices 78 in the rear face of the air cap. So in one extreme position of the air distributor, the horizontal pair of spray shaping bores receive air from the bores 76; whilst at the other, the vertical pair do. Thus the spray pattern can be extended vertically or horizontally by air from the horns impinging respectively horizontally or vertically on the paint flow from the nozzle 20 causing its vertical or horizontal extension.

Figure 11:
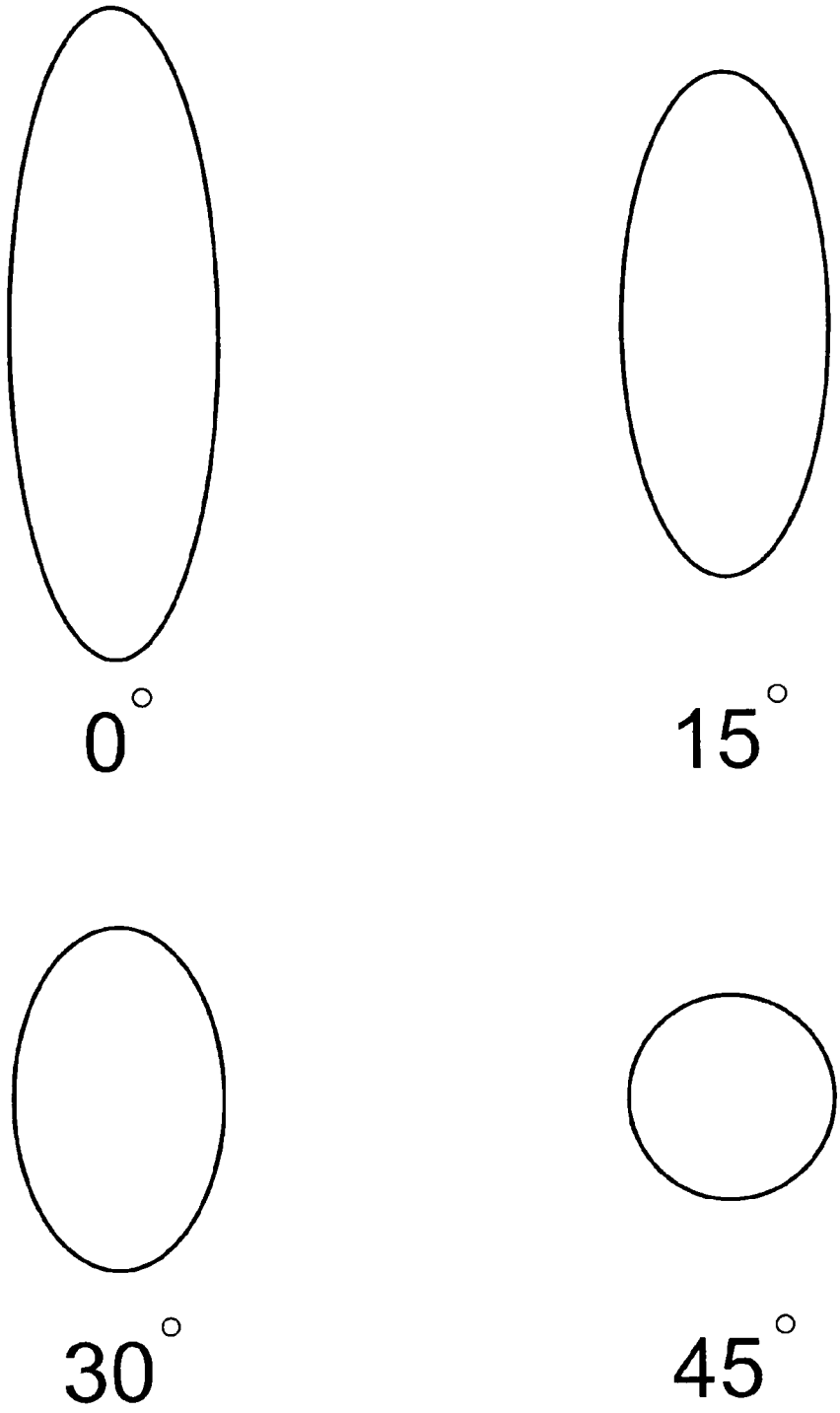
FIG. 11 is a set of diagrams showing differing spray patterns differing angles of adjustment of an air distributor in the gun.

When the air distributor is set midway between these extreme positions, the grooves 80 are each in communication at their opposite ends with an adjacent pair of air cap bores 77, whereby air is distributed to all four air horns, albeit with half the flow from the individual horns. The impinging flow is symmetrical and a symmetrical spray pattern is achieved. Intermediate positions distribute air predominantly to one pair of horns or the other, with some air passing out through the subsidiary pair. Thus progressive shape/patterning of the paint spray is possible. This is shown in FIG. 11, shows the change in pattern from the vertically extended shape achieved with the lug 17 extending upwards, to a compact symmetrical pattern having a round appearance with the lug extending at 45°.

It should be noted that at no position of the air distributor 16 is no air flow through any of the horns provided for. This avoids a resistance to air flow such as might cause excessive load on an air blower motor.

We claim:

1. An air spray gun comprising:
an air flow passage in the gun;
a spray liquid nozzle mounted in the air flow passage and having:
an orifice for spray liquid to flow from on the downstream side of the spray liquid nozzle with respect to both air and spray liquid flow;
a needle extending from upstream into the spray liquid nozzle for regulating its orifice and flow of the spray liquid and including a tip extending into the spray liquid nozzle;
a spray liquid flow passage in fluid communication with the spray liquid nozzle, with the needle extending in the spray liquid flow passage, the spray liquid nozzle being removable from the spray liquid flow passage;
a seal at a position along the needle spaced from the spray liquid nozzle;
a trigger mechanism connected to the needle to regulate its position;
an air cap, the air cap and spray liquid nozzle defining:
a convergent air flow region immediately upstream of the spray liquid orifice;
a central opening from which spray liquid entraining air flows; and
a pair of opposed horns having spray patterning bores with orifices directed inwards for patterning the spray liquid containing air flow from the central opening;
an air distributor upstream of the air cap for distributing air to the patterning bores; and
wherein:
the needle comprises:
an exchangeable front part;
a rear part with which the front part is removably engageable and to which the trigger mechanism connects; and
a formation extending radially from the exchangeable front part with which the front part can be gripped for its exchange, the front part being removable from a front of the spray liquid flow passage upon disengagement from the rear part.

2. A spray gun according to claim 1, wherein the exchangeable front part of the needle and the rear part have complementary threads on the two parts connecting them in the engagement region.

3. A spray gun according to claim 1, wherein the exchangeable front part of the needle includes a bayonet fitting for connection of the two parts in the engagement region.

4. A spray gun according to claim 1, wherein the seal between the needle and the spray liquid flow passage is removable with the exchangeable front part of the needle.

5. A spray gun according to claim 1, wherein the seal is secured in the spray liquid flow passage, whereby it remains in position on exchange of the front part of the needle.

6. A spray gun according to claim 1, wherein the seal is arranged at the rear part of the needle.

7. A spray gun according to claim 1, wherein the seal is arranged at the front part of the needle, whereby an engagement region between the two parts is isolated from the spray liquid by the seal.

8. A spray gun according to claim 1, wherein the seal is an elastomeric double lip seal.

9. A spray gun according to claim 1, wherein:
the air cap is rotatable; and
the air distributor is fixed and has:
passages set at 12 o'clock, 3 o'clock, 6 o'clock and 9 o'clock with respect to the normal orientation of the air spray gun, for providing patterning air flow to the patterning bores when the horns are at 12 o'clock and 6 o'clock or at 3 o'clock and 9 o'clock.

10. A spray gun according to claim 1, wherein:
the air cap has two pairs of opposed horns;
the four horns being set at 12 o'clock, 3 o'clock, 6 o'clock and 9 o'clock with respect to the normal orientation of the air spray gun,
each horn having a spray patterning bore with an orifice directed inwards and
the air distributor has a pair of diametrically arranged apertures through it and
the air distributor is rotatable to connect its apertures with the spray patterning bores of at least one of the two pairs of opposed horns.

11. An air spray gun, according to claim 10, wherein the air distributor has circumferential grooves facing the air cap, each groove having substantially quarter-circle extent.

12. An air spray gun, according to claim 11, wherein the apertures open into the middle of the grooves.

13. An air spray gun, according to claim 10, wherein the bores in the horns have circumferentially extended orifices in a rear face of the air cap.

14. An air spray gun, according to claim 10, wherein:
the air flow passage has a tubular front end having a slot; and
the air cap has a tang engaging in the slot for holding the air cap against rotation.

15. An air spray gun, according to claim 14, wherein:
the air distributor has a skirt extending within the tubular front end closing the slot against air flow; and
the slot has a Tee head in which an adjustment lug fast with the air distributor extends radially and is movable for adjustment of the air distributor.

16. An air spray gun, according to claim 10, wherein the spray liquid nozzle has a rear spigot sealingly fitted in a tubular front end of the spray liquid flow passage.

17. An air spray gun, according to claim 16, wherein an inner face of the air cap is conical and has a set of four nibs.

18. An air spray gun, according to claim 17, wherein the spray liquid nozzle has a front face which is conical and the nibs abut the spray liquid nozzle for centring of the air cap on the spray liquid nozzle.

19. An air spray gun, according to claim 1, wherein the air flow passage has a tubular rear portion and the trigger mechanism is bifurcated at its top, extending around the tubular rear portion and is pivotally connected to the tubular rear portion.

20. An air spray gun, according to claim 19, including an outer casing enclosing the tubular rear portion with the pivotal connection, the outer casing being integral with a handle for the air spray gun extending downwards from the outer casing.

21. An air spray gun, according to claim 20, including a snail cam arranged behind the trigger mechanism for controlling wherein the extent to which the needle can be drawn back.

22. An air spray gun comprising:

an air flow passage in the gun, a spray liquid nozzle mounted in the air flow passage and having:

an orifice for spray liquid to flow from on the downstream side of the spray liquid nozzle with respect to both air and spray liquid flow;

a needle extending from upstream into the spray liquid nozzle for regulating its orifice and flow of the spray liquid, the needle comprising a front part removably engageable to a rear part, and a formation extending radially from the front part, the front part being removable from a front of a spray liquid flow passage upon disengagement from the rear part;

the spray liquid flow passage being in fluid communication with the spray liquid nozzle, with the needle extending in the spray liquid flow passage;

a seal at a position along the needle spaced from the spray liquid nozzle;

a trigger mechanism connected to the needle to regulate its position;

an air cap defining:

a convergent air flow region immediately upstream of the spray liquid orifice;

a central opening from which spray liquid entraining air flows; and a pair of opposed horns having spray patterning bores with orifices directed inwards for patterning the spray liquid containing air flow from the central opening;

an air distributor upstream of the air cap for distributing air to the patterning bores; and wherein:

the air cap has two pairs of opposed horns, the four horns being set at 12 o'clock, 3 o'clock, 6 o'clock and 9 o'clock with respect to the normal orientation of the air spray gun, each horn having a spray patterning bore with an orifice directed inwards and the air distributor has a pair of diametrically arranged apertures through it and the air distributor is rotatable to connect its apertures with the spray patterning bores of at least one of the two pairs of opposed horns.

23. An air spray gun, according to claim 22, wherein the air distributor has circumferential grooves facing the air cap, each groove having substantially quarter-circle extent.

24. An air spray gun, according to claim 23, wherein the apertures open into the middle of the grooves.

25. An air spray gun, according to claim 22, wherein the bores in the horns have circumferentially extended orifices in a rear face of the air cap.

26. An air spray gun, according to claim 22, wherein:

the air flow passage has a tubular front end having a slot; and the air cap has a tang engaging in the slot for holding the air cap against rotation.

27. An air spray gun, according to claim 26, wherein:

the air distributor has a skirt extending within the tubular front end closing the slot against air flow and the slot has a Tee head in which an adjustment lug fast with the air distributor extends radially and is movable for adjustment of the air distributor.

28. An air spray gun, according to claim 22, wherein the spray liquid nozzle has a rear spigot sealingly fitted in a tubular front end of the spray liquid flow passage.

* * * * *